US006273198B1

(12) United States Patent
Bauer et al.

(10) Patent No.: US 6,273,198 B1
(45) Date of Patent: Aug. 14, 2001

(54) PITCH CONTROL SYSTEM

(75) Inventors: Jeffrey Alan Bauer; Jon Roy Williams; Ben Paul Tabor, all of Dubuque, IA (US)

(73) Assignee: Deere & Company, Moline, IL (US)

( * ) Notice: Subject to any disclaimer, the term of this patent is extended or adjusted under 35 U.S.C. 154(b) by 0 days.

(21) Appl. No.: 09/518,068

(22) Filed: Mar. 2, 2000

(51) Int. Cl.[7] ..... E02F 3/76
(52) U.S. Cl. ..... 172/825; 172/826
(58) Field of Search ..... 172/2, 3, 7, 810, 172/811, 812, 813, 819–828; 37/348, DIG. 10

(56) References Cited

U.S. PATENT DOCUMENTS

| | | | | |
|---|---|---|---|---|
| 3,900,073 | | 8/1975 | Crum | 172/430 |
| 4,962,816 | * | 10/1990 | Imon et al. | 172/821 |
| 5,069,296 | * | 12/1991 | Horsch | 172/825 |
| 5,507,352 | | 4/1996 | Frisbee et al. | 172/818 |
| 5,682,955 | | 11/1997 | Groth et al. | 172/811 |
| 5,901,793 | * | 5/1999 | Frisbee | 172/816 |

OTHER PUBLICATIONS

John Deere Dubuque Works Operator's Manual entitled "450G, 550G, and 650G Torque Converter and Direct Drive Crawler Dozers", OMT159724 Issue B6, cover and pages 35–1 thru 35–6, printed in the U.S.A., (Jan. 1993).

* cited by examiner

*Primary Examiner*—Robert E. Pezzuto

(57) ABSTRACT

A pitch control system for a bulldozer having a bulldozer blade that is mounted to a blade linkage. The bulldozer blade is coupled to the blade linkage by a bearing that permits the right and left angling movement of the bulldozer blade and the forward and rearward pitch of the bulldozer blade relative to the blade linkage. An angling control valve hydraulically positions two hydraulic angling cylinders for angling the blade right and left relative to the blade linkage. A hydraulic dump valve is hydraulically positioned between the angling hydraulic control valve and the hydraulic angling cylinder, the hydraulic dump valve having a dump position and a checked position. A linear actuator in the form of a hydraulic pitch cylinder is operatively positioned between the blade linkage and the blade for selectively adjusting the pitch of the blade relative to the blade linkage. A pitch control valve is used to selectively position the pitch cylinder. The dump valve is shifted to its dump position whenever the pitch cylinder is extended or retracted thereby freeing the angling cylinders.

17 Claims, 3 Drawing Sheets

28
10
20
12
32
30
34
24
16
18
22
14

16
34
22
30
32
24
18
20
20

PITCH CONTROL SYSTEM

BACKGROUND OF THE INVENTION

1. Field of the Invention

The invention is directed to a bulldozer having an electrically operated pitch control system wherein the hydraulic angling cylinders are automatically coupled to tank when the hydraulic pitch cylinder is extended or retracted.

2. Description of the Prior Art

Both wheeled and tracked tractors may be provided with a forwardly mounted bulldozer blade for pushing dirt and other material. Typically the blade is coupled to a blade linkage which in turn is coupled to the frame of the tractor. The blade linkage is pivotally coupled to the tractor. Hydraulic raise and lower cylinders extend between the blade linkage and the supporting frame of the tractor for raising and lowering the blade. The blade itself is coupled to the linkage by a spherical bearing. The bulldozer blade, in turn, can be angled to the right and left relative to the linkage by hydraulic angling cylinders. By angling the blade dirt and other material is deposited on a selected side of the tractor.

The fore and aft pitch of some bulldozer blades can also be adjusted. It is desirable to adjust the pitch of the blade for different operations and conditions. On utility bulldozers, the assignee of the present patent application has provided specialized three hole pinning links to adjust the pitch position or three different pitch links for three different pitch positions, see U.S. Pat. No. 5,507,352. The pitch of the bulldozer blade is adjusted by moving the top portion of the blade forward and backward relative to a lower spherical bearing. In addition, hydraulic cylinders have also been proposed to adjust blade pitch, see U.S. Pat. No. 3,900,073.

SUMMARY

It is an object of the present invention to provide a pitch control system for a bulldozer blade that can be easily operated from the operators station and which releases the hydraulic angling cylinders when pitch is being adjusted.

A bulldozer is provided with a supporting frame and ground engaging means for supporting and propelling the frame. The ground engaging means may either be wheels or tracks. A blade linkage is pivotally coupled to the frame and is provided with two hydraulic raise and lower cylinders for raising and lowering the linkage relative to the frame. A bulldozer blade is mounted to the front of the linkage by a spherical bearing. Two double acting hydraulic cylinders are used to angle the blade to the right and left relative to the linkage. A longitudinally extending double acting hydraulic pitch cylinder is positioned between the linkage and blade for adjusting the pitch of the blade relative to the linkage.

The pitch of the bulldozer blade is controlled by a three position rocker switch located in the operator station of the vehicle. The rocker switch selectively positions a three position pitch control valve. The pitch control valve is a solenoid actuated valve having a second extension solenoid and a third retraction solenoid. The rocker switch and the pitch control valve are normally biased into their second neutral positions. The hydraulic angling system comprises an angling control valve and hydraulic angling cylinders. A two position hydraulic dump valve having a dump position and a check position is hydraulically positioned between the angling control valve and the hydraulic angling cylinders. The dump valve is normally biased into its checked position, but is shifted into its dump position when a first solenoid is energized. Whenever the rocker switch is activated to extend the hydraulic pitch cylinder the second extension solenoid is energized to shift the pitch control valve and the first solenoid of the dump valve is also energized shifting the dump valve into its dump position. Whenever the rocker switch is activated to retract the hydraulic pitch cylinder the third retraction solenoid is energized to shift the pitch control valve and the first solenoid of the dump valve is also energized shifting the dump valve into its dump position. Therefore whenever the hydraulic pitch cylinder is extended or retracted the dump valve is shifted to its dump position so that the angling cylinders do not interfere with the pitch adjustment.

DETAILED DESCRIPTION

Figure 1:
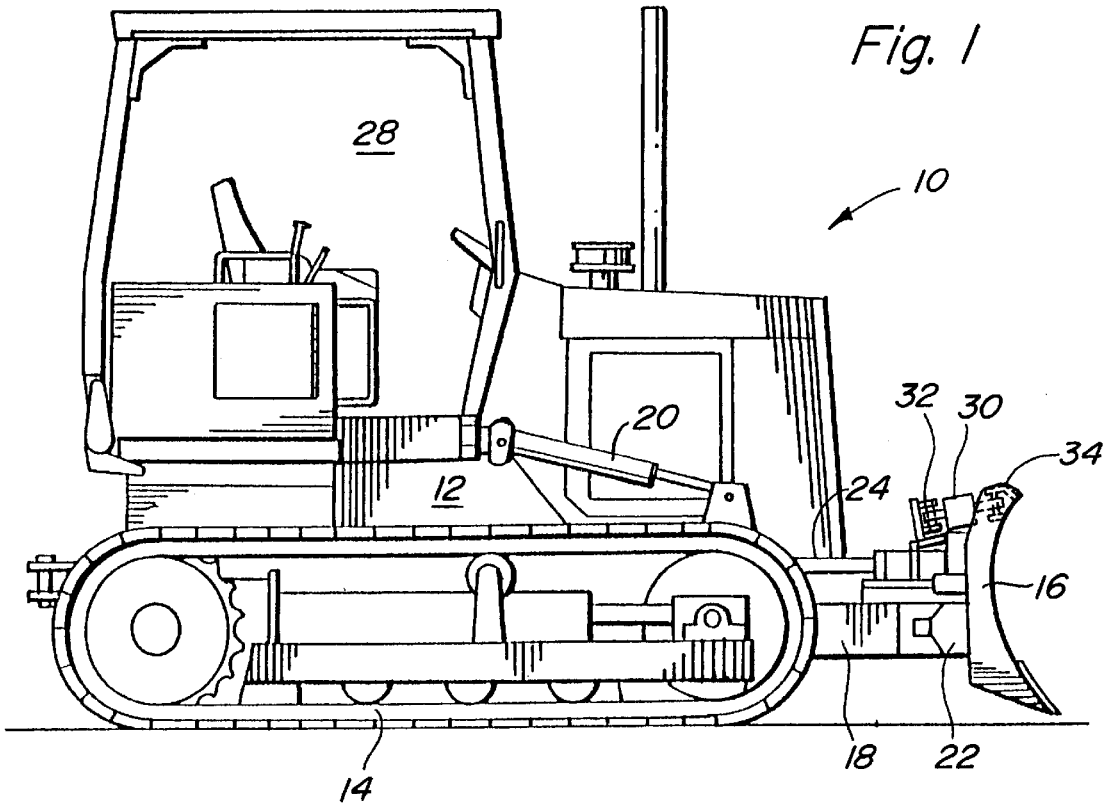
FIG. 1 is a side view of a tracked bulldozer having the present pitch control system.
Figure 2:
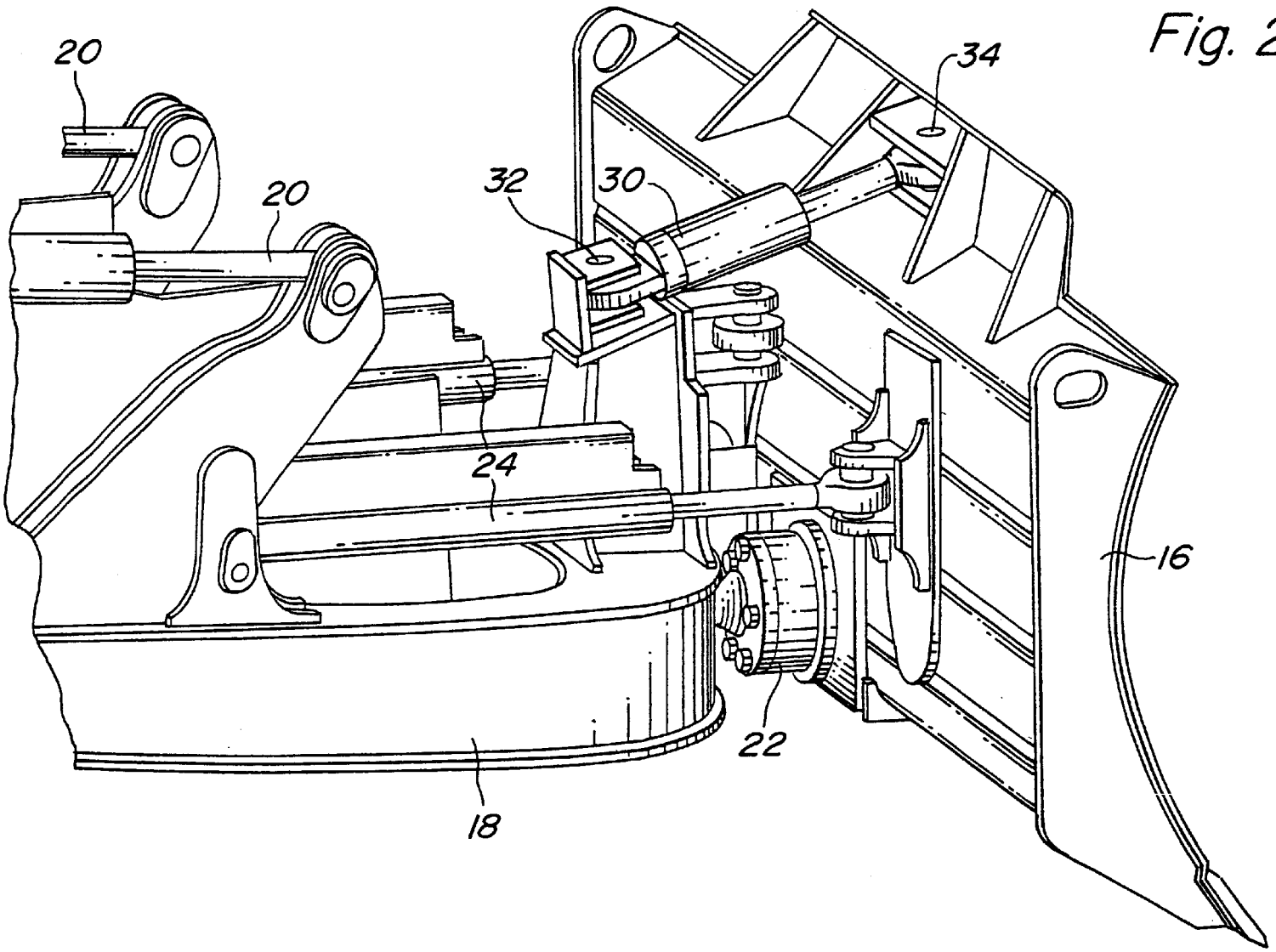
FIG. 2 is a perspective view of the bulldozer blade linkage and the bulldozer blade illustrating the present pitch control system.

FIG. 1 illustrates a bulldozer 10 having a supporting frame 12 and ground engaging tracks 14. The ground engaging tracks may be friction or positively driven rubber belts, or conventional steel tracks. In addition, ground engaging wheels may be used in place of ground engaging tracks 14 for a wheeled bulldozer. The bulldozer 10 is provided with a bulldozer blade 16 that is coupled to the frame 12 by blade linkage 18. In the illustrated embodiment the linkage 18 comprises a C-frame that is pivotally coupled to the supporting frame 12. The linkage 18 and the attached blade are raised and lowered by hydraulic cylinders 20 located between the linkage 18 and the frame 12. The blade 16 is coupled to the linkage 18 by a spherical bearing 22 that allows the blade to be angled to the right and left, and to be pitched fore and aft relative to the linkage. The blade is angled to the right and left by hydraulic cylinders 24, the positioning of which are controlled by hydraulic angling control valve 26. The extension and retraction of these hydraulic cylinders is controlled by the operator through a T-bar control lever located in operators area 28.

The pitch of the blade is controlled by the extension and retraction of a remotely operable linear actuator 30. In the illustrated embodiment the linear actuator is a double acting hydraulic cylinder, however single acting hydraulic cylinders may also be used as well as hydraulic and electric rotary motors driving linear actuators in the form of screw jacks. The linear actuator 30 is coupled to the blade linkage 18 at pin 32 and to bulldozer blade 16 at pin 34. The linear actuator 30 does not have to be directly coupled to the blade 16 and the linkage 18, but may include intervening linkage operatively coupling the output of the linear actuator 30 to both the linkage 18 and blade 16. However in the preferred embodiment the linear actuator is a double acting hydraulic cylinder the extension and retraction of which is controlled by pitch control valve 36. The pitch control valve 36 is a three-position valve having a first extension position 38, a second neutral position 40 and a third retraction position 42.

Figure 3:
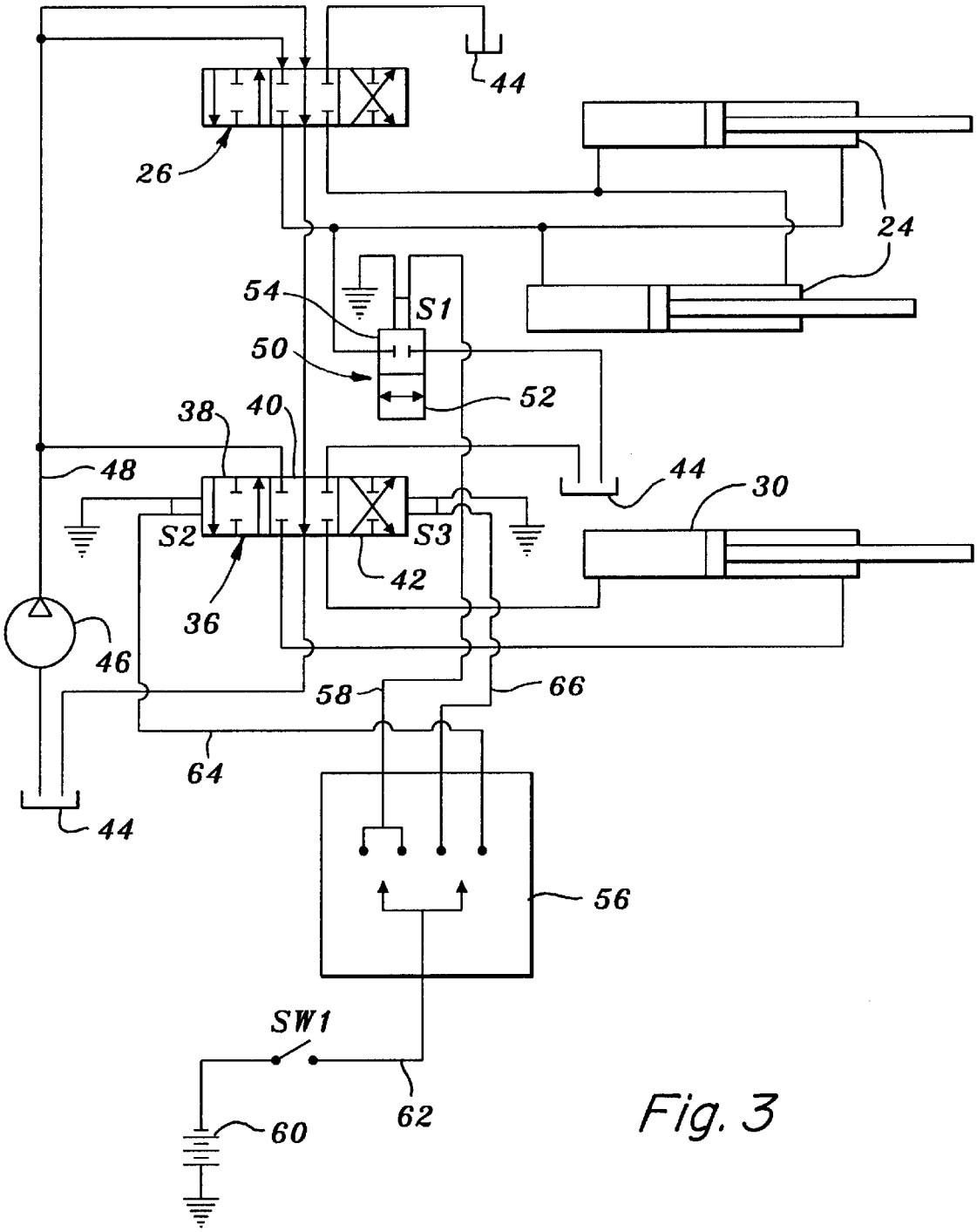
FIG. 3 is a hydraulic and electrical schematic of the present pitch control system.

As illustrated in the hydraulic and electrical schematic in FIG. 3, hydraulic fluid from tank 44 is pressurized by pump 46 and directed through supply line 48 to the angling control valve 26 and the pitch control valve 36. By manipulating the angling control valve 26 the hydraulic angling cylinders 24 are selectively extended and retracted to change the angle of the blade 16 relative to the linkage 18. Similarly by manipulating the pitch control valve 36 the hydraulic pitch cylinder 30 is extended and retracted changing the pitch of the blade 16 relative the to the linkage 18. Exhausted hydraulic fluid from the angling and pitch cylinders 24 and 30 is returned to tank 44.

Hydraulically positioned between the hydraulic angling cylinders 24 and the angling control valve 26 is a two-position dump valve 50 having a dump position 52 and a checked position 54. The dump valve 50 is shifted to its dump position by a first solenoid S1. The dump valve 50 is normally biased into its checked position 54. The first solenoid S1 is coupled to a three-position rocker switch 56 by line 58. The rocker switch 56 in turn is coupled to a source of electrical energy 60 by line 62.

The pitch control valve 36 is provided with a second extension solenoid S2 and a third retraction solenoid S3. The second solenoid S2 is electrically coupled to the rocker switch 56 through line 64. When the second solenoid S2 is energized, the pitch control valve 36 is shifted to its first extension position 38 and directs pressurized hydraulic fluid from the pump 46 to extend the hydraulic pitch cylinder 30. Similarly, if the third solenoid S3 is energized the pitch control valve 36 is shifted to its third retraction position 42 so that pressurized hydraulic fluid retracts the hydraulic pitch cylinder 30. The third solenoid S3 is electrically coupled to the rocker switch by line 66.

As shown in FIG. 3, the rocker switch 56 is in its second neutral position. If the rocker switch is shifted to the right as illustrated in FIG. 3, the rocker switch is shifted into its first extension position. In its first extension position electrical energy from the source of electrical energy 60 is transmitted to the first and second solenoids S1 and S2 by lines 62 and 64, respectively. If the rocker switch 56 is shifted to the left as illustrated in FIG. 3, the rocker switch is shifted into its third retraction position. In its third retraction position electrical energy from the source of electrical energy 60 is transmitted to the first and third solenoids S1 and S3 by lines 62 and 66, respectively. When the hydraulic pitch cylinder 30 is being extended or retracted, the first solenoid S1 shifts the dump valve 50 so that pressurized hydraulic fluid trapped in the angling cylinders 24 can return to the tank 44. This prevents interference with the angling system when the pitch is being adjusted. After the correct pitch is set, the operator, if necessary, can reset the selected angling position by manipulating the angling control valve 26.

Switch SW1 is a brake switch and is normally biased open and is closed only when the brakes are applied. By locating switch SW1 in series with the rocker switch, the pitch control system cannot be operated as the bulldozer is moving The invention should not be limited to the above-described embodiment, but should be limited solely by the claims that follow.

What is claimed is:

1. A bulldozer comprising, a supporting frame, ground engaging means for supporting and propelling the supporting frame;

a blade linkage pivotally mounted to the supporting frame whereby the blade linkage can be raised and lowered relative to the supporting frame;

a bulldozer blade is mounted to the blade linkage by a bearing which permits the bulldozer blade to pitch forwardly and rearwardly, and to be angled to the right and left relative to the blade linkage;

a hydraulic angling cylinder operatively positioned between the blade linkage and the bulldozer blade for angling the bulldozer blade right and left;

a hydraulic pitch cylinder operatively positioned between the blade linkage and the bulldozer blade for adjusting the pitch of the bulldozer blade relative to the blade linkage;

a hydraulic circuit for actuating the hydraulic angling cylinder and the hydraulic pitch cylinder, the hydraulic circuit comprising an angling control valve for directing hydraulic fluid to and from the hydraulic angling cylinder and a pitch control valve for directing hydraulic fluid to and from the hydraulic pitch cylinder, a hydraulic dump valve having a dump position and a checked position is hydraulically positioned between the hydraulic angling cylinder and the angling control valve for releasing hydraulic fluid in the hydraulic angling cylinder when the hydraulic pitch cylinder is extended and retracted.

2. A bulldozer as defined by claim 1 wherein the bearing is a spherical bearing located between the bulldozer blade and the blade linkage.

3. A bulldozer as defined by claim 2 wherein the pitch control valve has three positions, an extension position, a retraction position and a neutral position, whenever the pitch control valve is shifted into its extension position and its; retraction position, the hydraulic dump valve is shifted from its checked position to its dump position.

4. A bulldozer as defined by claim 3 wherein the hydraulic dump valve is a solenoid actuated valve having a first solenoid and the pitch control valve is a solenoid actuated valve having a second solenoid and a third solenoid.

5. A bulldozer as defined by claim 4 wherein the first, second and third solenoids are energized by a three-position switch, the three position switch having a first extension position, a second neutral position and a third retraction position, when the switch is shifted into its first extension position the first and the second solenoids are energized shifting the pitch control valve so that pressurized hydraulic fluid is directed to the hydraulic pitch cylinder to extend the hydraulic pitch cylinder and shifting the dump valve into its dump position.

6. A bulldozer as defined by claim 5 wherein when the three-position switch is shifted into its second neutral position the first solenoid, the second solenoid and the third solenoid are not energized and the pitch control valve is in its neutral position and the dump valve is in its checked position.

7. A bulldozer as defined by claim 6 wherein when the three-position switch is shifted into its third retraction position, the first and third solenoids are energized shifting the pitch control valve so that pressurized hydraulic fluid is directed to the hydraulic pitch cylinder retracting the hydraulic pitch cylinder, in addition the dump valve is shifted to its dump position.

8. A bulldozer as defined by claim 4 wherein the first, second and third solenoids are energized by a three-position switch, the three-position switch has a first extension position, a second neutral position and a third retraction position, when the switch is shifted into its third retraction position both the first and third solenoids are energized shifting the pitch control valve so that pressurized hydraulic fluid is directed to the hydraulic pitch cylinder retracting the hydraulic pitch cylinder, in addition the dump valve is shifted into its dump position.

9. A bulldozer as defined by claim 7 wherein the three-position switch is a rocker switch and the rocker switch is biased into its second neutral position.

10. A bulldozer as defined by claim 9 wherein the hydraulic pitch cylinder is a double acting hydraulic cylinder.

11. A bulldozer as defined by claim 10 wherein a brake switch is mounted in series with the rocker switch and is closed when the bulldozer is stopped and open when the bulldozer is moving.

12. A bulldozer as defined by claim 1 wherein a brake switch is mounted in series with the rocker switch and is closed when the bulldozer is stopped and open when the bulldozer is moving.

13. A pitch control system for a bulldozer having a bulldozer blade that is mounted to a blade linkage wherein the bulldozer blade is coupled to the blade linkage by a bearing that permits the right and left angling movement of the bulldozer blade and the forward and rearward pitch of the bulldozer blade relative to the blade linkage, the bulldozer is further provided with a hydraulically actuated system for angling the blade having an angling control valve and a hydraulic angling cylinder, the pitch control system comprising:

a hydraulic dump valve hydraulically positioned between the angling hydraulic control valve and the hydraulic angling cylinder, the hydraulic dump valve having a dump position and a checked position;

a linear actuator for changing the pitch of the bulldozer blade relative to the blade linkage, the linear actuator can be extended and retracted;

whereby the dump valve is shifted to its dump position whenever the linear actuator is extending or retracting.

14. A pitch control system as defined by claim 13 further comprising an electrical switch for extending and retracting the linear actuator.

15. A pitch control system as defined by claim 14 wherein a brake switch is mounted in series with the electrical switch and is closed when the bulldozer is stopped and open when the bulldozer is moving.

16. A pitch control system as defined by claim 15 wherein the linear actuator is a double acting hydraulic cylinder and the electrical switch manipulates a pitch control valve that directs hydraulic fluid to the double acting cylinder.

17. A pitch control system as defined by claim 16 wherein the pitch control valve is a solenoid actuated valve having a second extension solenoid and a third retraction solenoid that are electrically coupled to the switch and the dump valve is provided with a first solenoid that is electrically coupled to the electrical switch.

* * * * *